United States Patent [19]

Speranza

[11] Patent Number: 4,537,353

[45] Date of Patent: Aug. 27, 1985

[54] LOW-POWER ACOUSTIC INJECTOR DRIVE CIRCUIT WITH ENHANCED TURN-ON

[75] Inventor: Donald Speranza, Canton, Mich.

[73] Assignee: Eaton Corporation, Cleveland, Ohio

[21] Appl. No.: 470,794

[22] Filed: Feb. 28, 1983

[51] Int. Cl.[3] ..... B05B 3/14

[52] U.S. Cl. ..... 239/102; 310/316; 363/15; 123/494

[58] Field of Search ..... 239/4, 102; 123/478, 123/491, 494; 363/15; 310/316–318, 321, 323, 325; 318/116, 118

[56] References Cited

U.S. PATENT DOCUMENTS 3,860,864 1/1975 Fitz ..... 363/15

4,054,848 10/1977 Akita ..... 310/317

4,366,582 6/1982 Brantley et al. ..... 363/15

*Primary Examiner*—Andres Kashnikow

*Assistant Examiner*—James R. Moon, Jr.

*Attorney, Agent, or Firm*—C. H. Grace; J. G. Lewis

[57] ABSTRACT

An acoustic fuel injector system comprises a DC-to-DC converter (14) for supplying a regulated voltage to a frequency controlled oscillator (16) which drives the injector valve (18) or valves. The converter comprises a flyback oscillator (28) including a switching transistor (32) and a transformer (34, 36) for applying rectified current pulses of variable amplitude and occurrence rate to an output capacitor (42). A variable impedance device (50) in the input circuit to the flyback oscillator is controlled by a feedback signal (68) from the output circuit (30) to vary the cycle rate of the flyback oscillator to maintain output voltage at a desired value. The feedback signal is coupled to the oscillator control circuit input to effect a variable regulated output voltage which is relatively high upon injector turn-on but decays to a lower operating level thereafter.

21 Claims, 7 Drawing Figures

LOW-POWER ACOUSTIC INJECTOR DRIVE CIRCUIT WITH ENHANCED TURN-ON

FIELD OF THE INVENTION

This invention relates to injection systems of the type using one or more acoustically resonant structures and particularly to fuel injection systems including DC power supplies and DC-to-DC converters.

CROSS-REFERENCE

The invention described in the present application represents an improvement of those described in U.S. Ser. No. 388,350 and U.S. Ser. No. 388,400, now U.S. Pat. No. 4,469,974 both filed July 14, 1982.

BACKGROUND OF THE INVENTION

Fuel injectors for internal combustion engines commonly used solenoid-operated valves to meter fuel under pressure either upstream of a manifold-type distribution system or on an individual cylinder basis at a point near the intake valve. The former arrangement is commonly called "throttle body injection" and the latter is commonly called "multipoint injection".

More recently, it has been discovered that the fuel metering function and an atomizing function can be achieved using an acoustically resonant structure that is periodically excited with an alternating current excitation signal. Although such structure may take various forms, it may be generally described as comprising the combination of a mechanical device, such as a catenoidal horn-shaped injector body, and an electrical device such as a piezoelectric crystal or an arrangement of several such crystals. One combination pertinent to the invention described herein comprises a catenoidal horn having a ball check valve in the fuel flow path near the small tip of the horn and a pair of electrically parallel connected piezoelectric crystals mechanically abutting the large end of the horn. When the crystals are excited by an alternating current pulse of controlled frequency and amplitude, the horn is set into resonant vibration to unseat the ball and to permit a metered quantity of fuel to flow to the combustion chamber or chambers.

The successful use of an acoustic fuel injector requires the ability to precisely control the injected fuel quantity under varying operating conditions. Such control is, in great measure, affected by the degree to which the frequency of the excitation signal matches the mechanically resonant frequency of the acoustic structure; i.e., even a small mismatch results in decreased vibration amplitude at the tip of the horn where metering and atomization take place. This is a difficult match to maintain because, as previously described, the resonant structure includes both electrical and mechanical components. Moreover, the resonant frequency of the structure is not constant; rather, it is known to vary significantly with temperature, load, and contamination level. Unless the frequency of the excitation signal can be made to follow such variations in mechanical resonant frequency, precise fuel metering is not possible.

The ability to generate an excitation signal of controlled frequency and amplitude is at least in part dependent upon the stability of the DC voltage which is available to the excitation signal oscillator-generator. As a result, there are numerous applications, particularly in the automotive and vehicular fields, for a DC-to-DC converter which operates to provide a highly stabilized output voltage despite substantial variations in the supply voltage furnished by, for example, a 12 V automotive battery.

In the fuel injection system application, as well as other applications, it is also advantageous to provide a reliable start-up function for the converter oscillator and to minimize the number of required components for production economy.

An oscillator circuit with reliable start-up characteristics is shown in FIG. 2.43 of "Design of Solid State Power Supplies", Second Edition by E. R. Hnatek, van Nostrand Reinhold Company, p. 78. In that circuit, the primary winding of an output transformer in the oscillator output circuit is coupled to a tertiary winding in the oscillator input circuit to provide positive feedback. FIGS. 2.44 and 2.45 on Page 80 of the same publication illustrate converter circuits having a feedback connection from the output circuit to the inputs of the oscillator for regulation purposes. However, these circuits are characterized by a large number of circuit components with a corresponding lack of product economy.

A related aspect of prior art fuel injection systems is the interrelationship of component power handling capability versus characteristic response time. These circuits tended to trade off economy for enhanced response.

BRIEF DESCRIPTION OF THE INVENTION

A DC-to-DC converter circuit has many vehicular and nonvehicular applications but is especially useful as a power supply to the oscillator of an acoustic fuel injection system. The converter circuit is characterized by output voltage stability under varying input voltage and load conditions, enhanced response with low power consumption, reliable start-up and low part count. In brief, the advantages of the invention are realized in a converter circuit comprising a mechanically resonant injector structure which responds to an alternating current excitation signal to atomize fluid such as fuel supplied thereto. An oscillator circuit produces the excitation signal in response to receipt of a control signal which is internally or externally generated. Additionally, a DC-to-DC converter produces a selectively variable regulated output voltage from an unregulated supply, whereby power applied to the injector varies with converter output voltage level. With this arrangement, a power boost can be effected momentarily during a portion of the injector duty cycle while retaining relatively low steady state power ratings of the componentry.

In the preferred embodiment of the invention, the variable regulated output voltage of the DC-to-DC converter energizes the oscillator as a function of the control signal. This arrangement has the advantage of effecting modulation of the oscillator circuit as well as varying the regulated output voltage from a single source. It is recognized however that separate independent control signals could be employed, if desired.

In the embodiment hereinafter described in detail, the converter circuit includes a flyback oscillator which is coupled to a capacitive output circuit and which is operated in a variable frequency mode by means of a feedback-controlled variable impedance device connected to the oscillator input. A feedback signal representing the output voltage is differentially compared to a reference voltage to control the variable impedance device so as to decrease the oscillator frequency as additional output power is needed.

According to another feature of the present invention, the oscillator includes a transformer having a primary winding in series with the active oscillator device, a first secondary winding coupled by a diode rectifier to an output capacitator to charge the capacitator during the flyback interval, and a tertiary winding connected by a diode rectifier to the variable impedance device to maintain oscillations. A resistor connected between the secondary windings provides additional loop gain to assist start-up.

These and other features and advantages of this invention will become apparent upon reading the following Specification, which, along with the patent drawings, describes and discloses a preferred illustrative embodiment of the invention in detail.

The detailed description of the specific embodiment makes reference to the accompanying drawings.

Figure 3:
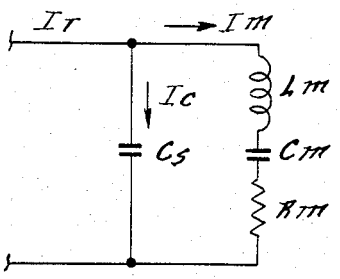

FIG. *2a* is a circuit diagram of a DC-to-DC converter embodying the present invention;

FIG. *2b* is a schematic diagram of a preferred oscillator using piezoelectric actuator crystals;

FIG. 3 is an equivalent circuit diagram of a mechanically resonant structure of the type used in the device of FIG. *2b;*

Figure 4:
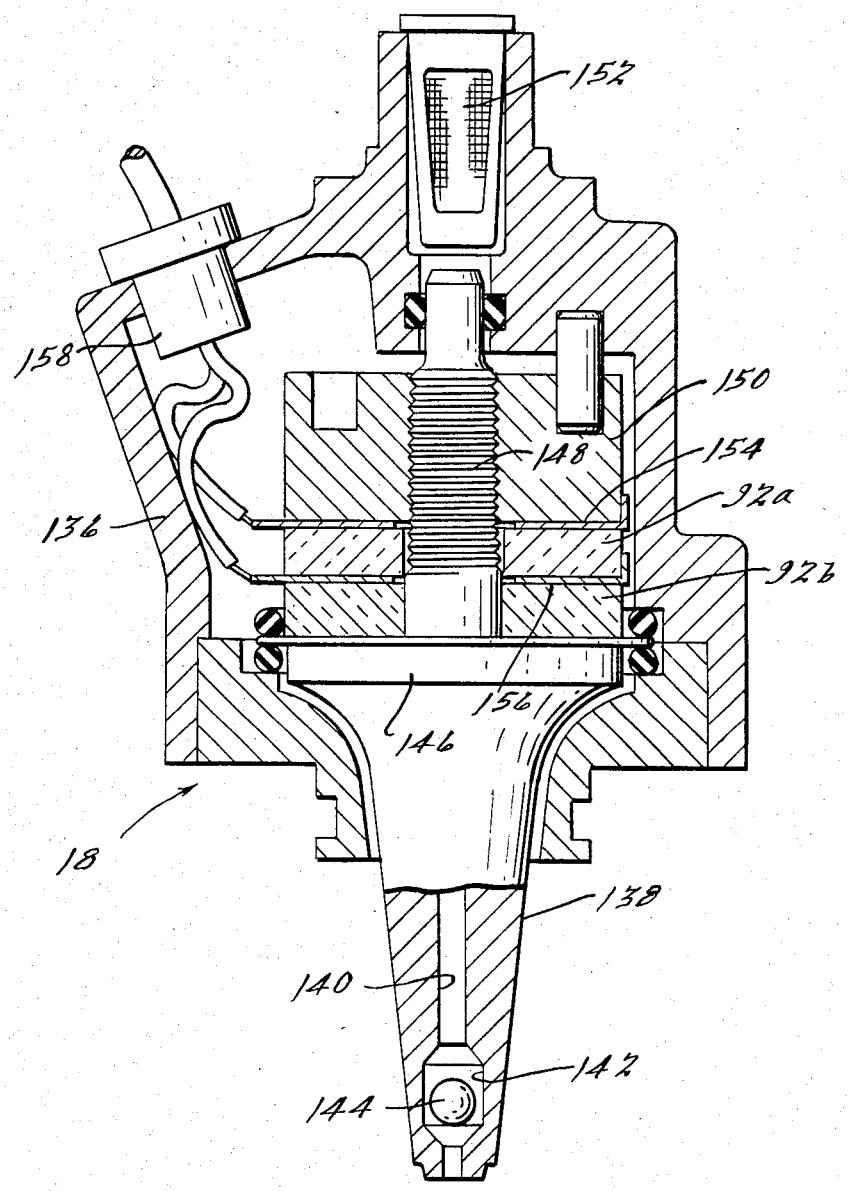

FIG. 4 is a sectional view of an injector device useful in the circuit of FIG. *2b;*

Figure 5:
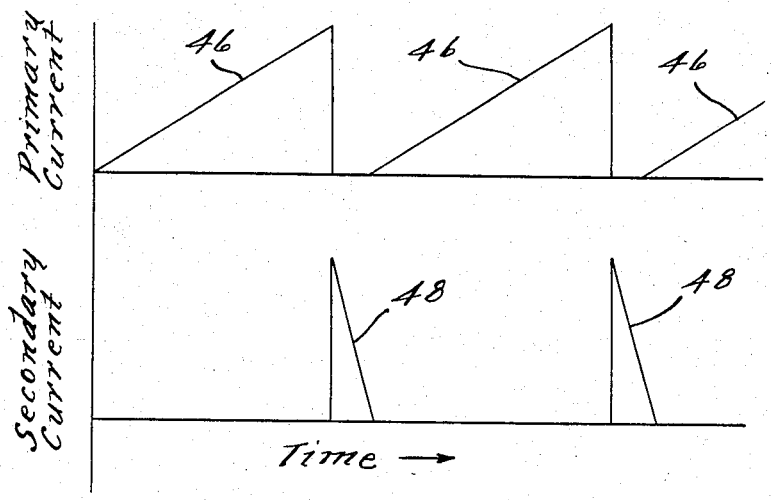
Figure 6:
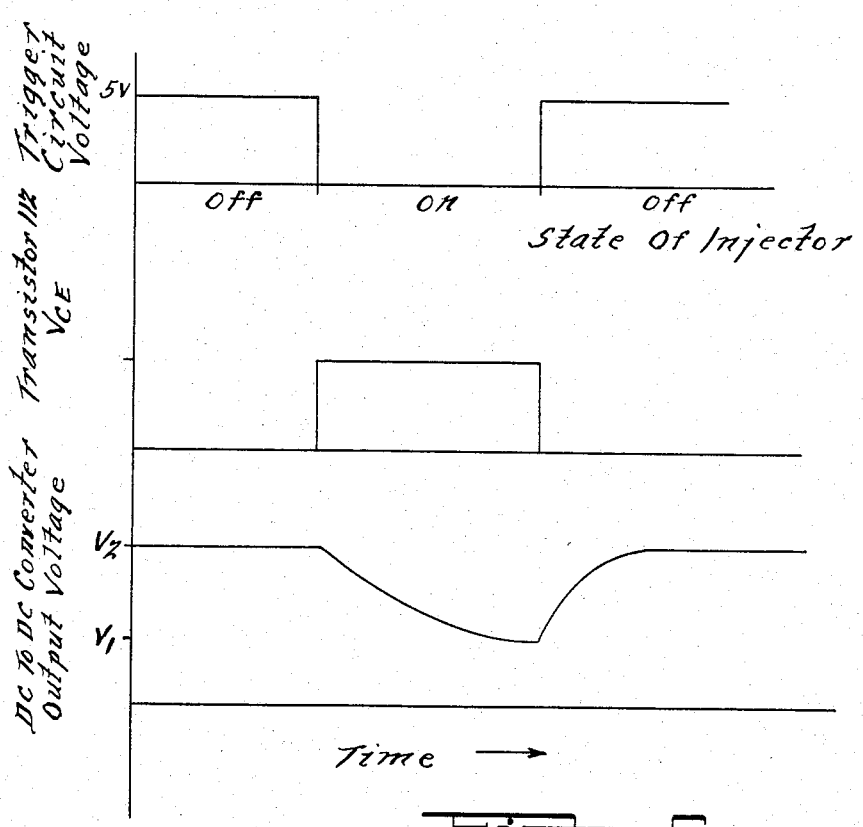

FIG. 5 is a set of waveform diagrams showing the current patterns of the circuit of FIG. *2a* under given operating conditions; and FIG. 6 is a set of waveform diagrams showing the voltage patterns in the circuit of FIG. *2a* under given operating conditions.

DETAILED DESCRIPTION OF THE SPECIFIC EMBODIMENT

Figure 1:
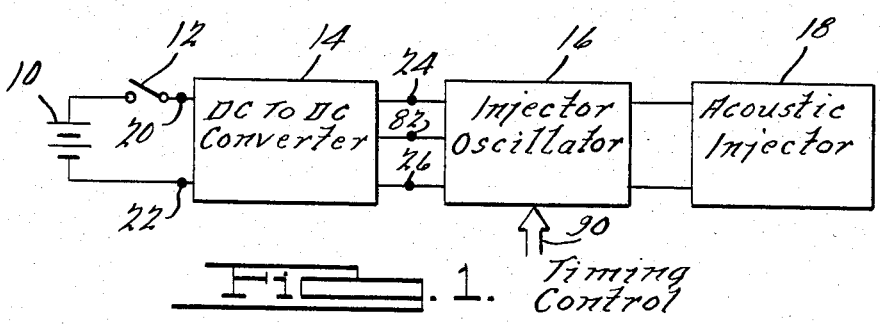
FIG. 1 is a block diagram of an acoustic fuel injection system incorporating the novel converter circuit as a power supply to an oscillator.

FIG. 1 illustrates in block diagram a fuel injector system comprising a conventional 12 V storage battery 10 connected through a switch 12 to a DC-to-DC converter 14 which, in accordance with the invention, provides a selectively variable regulated supply voltage to an oscillator circuit 16. The oscillator circuit is connected to an acoustic injector 18, preferably of the catenoidal horn-type to excite the injector with an alternating current pulse of closely controlled frequency and amplitude. The timing of the alternating current pulse is a function of the engine speed and fuel demand and is controlled by an external means not described herein. Although described in the environment of an automobile fuel injection system, it is understood that the present invention can be employed in nonfuel, fluid injection applications.

A full description of the injector circuit 16, and acoustic injector 18 having piezoelectric actuated crystals, and the manner in which the oscillator circuit and the injector are connected is given in a copending application entitled "Low Power Acoustic Injector Driver Circuit", U.S. Ser. No. 388,400 filed July 14, 1982, filed in the name of the present inventor and assigned to Eaton Corporation. Furthermore, details of a preferred converter circuit may be found in another copending application entitled "Fuel Injector Power Supply Including Regulated DC-to-DC Converter", U.S. Ser. No. 388,354 filed July 14, 1982, filed in the name of the present inventor and assigned to Eaton Corporation. Both of the above referenced copending applications are hereby incorporated herein by reference.

As will be described in greater detail herein below, DC-to-DC converter 14 provides oscillator circuit 16 with, in effect, a selectively variable regulated voltage level to effect a power boost when injector 18 is initially turned on. This approach is opposed to prior art systems which provided constant power to the injector. The present invention provides a power boost only during turn-on with a power decay to a lower level for longer pulse width and continuous operation, thereby reducing power supply and drive circuit (steady state ratings) requirements.

Referring now to FIG. *2a,* the details of the converter 14 are shown to comprise input terminals 20 and 22 to be connected to the 12 V battery 10, and output terminals 24 and 26 across which appears the regulated (200 V nominal) DC output.

Converter 14 further comprises a flyback oscillator generally designated by reference numeral 28 and an output circuit generally designated by reference numeral 30. The principal elements of the flyback oscillator 28 include a pnp transistor 32 and a transformer comprising primary winding 34, secondary winding 36 and tertiary winding 38, all of such windings being wound on a common core in the senses indicated by the dots adjacent the respective windings in FIG. *2a.* Primary winding 34 is connected in series with the emitter-collector circuit of transistor 32 to receive charging current therefrom during the charging interval. Secondary winding 36 is connected to the output circuit 30 through a diode 40 to supply charging pulses to a capacitor 42 during the flyback interval as hereinafter described. Tertiary winding 38 is connected in series with a diode 44 to maintain oscillations as also hereinafter described.

Generally, the flyback oscillator 28 produces a current waveform through primary winding 34 comprising ramp-like pulses 46 as shown on the top line of FIG. 5. During the relatively short flyback interval, current flows through the secondary winding 36, through the diode 40 and into the output capacitor 42 in the form of pulses 48 as shown on the bottom line of FIG. 5.

To vary the frequency or rate of occurrence of pulses 46 and 48, a variable impedance device in the form of a pnp transistor 50 has its emitter connected to the base of oscillator transistor 32 and to the 12 V input terminal 20 through a resistor 52, its collector connected to the diode 44, to terminal 20 through a resistor 54 and to the winding 36 through a resistor 56, and its base connected to the collector of an npn transistor 58 which is differentially paired with a similar npn transistor 60 for voltage regulation purposes to be described. The emitters of both transistors 58 and 60 are connected to the grounded input terminal 22 through a resistor 62 and the collector of transistor 60 is connected to the 12 V input terminal 20. To control the impedance of transistor 50 and, hence, the frequency of the flyback oscillator 28 according to the output voltage across capacitor 42, voltage divider resistors 64 and 66 are connected in series across the capacitor 42 and the junction between the two resistors is connected via feedback line 68 to the base of transistor 60 in differential pair 58, 60. The base of transistor 60 thus varies in potential in direct proportion to the voltage across capacitor 42 and the output terminals 24, 26. The base of transistor 58, on the other hand, is connected to a steady reference potential provided by the series combination of resistor 70 and Zener diode 72, this series combination being connected across the 12 V input terminals 20, 22. A capacitor 74 connected across terminals 20, 22 eliminates or reduces current spikes from the battery 10. It is understood that resistor 70 and Zener diode 72 could be replaced by a separate reference voltage source. A control line 76, including series connected resistor 78 and diode 80 interconnect feedback line 68 with a control terminal 82 connected to oscillator 16 as will be described in detail herein below.

Describing now the operation of the circuit of FIG. *2a*, prior to the closure of switch 12 to apply 12 V across terminals 20, 22, the output voltage across terminals 24, 26 is zero. When the input voltage is applied, the reference voltage provided by Zener diode 72 comes up immediately to turn on transistor 58. This allows transistor 58 to draw current through the emitter-base circuits from both transistors 50 and 32, forward biasing transistor 32 to start the oscillator cycle. Since the collector current of transistor 32 is initially small, the transistor 32 saturates and applies the full 12 V input across primary winding 34. The primary current pulse 46 begins to ramp up as shown in FIG. 5. Since diode 40 prevents any flow of secondary current in winding 36, secondary current is reflected in the base current of transistor 32 through winding 38, diode 44, and transistor 50. When the current in winding 38 builds up sufficiently, it is limited by the conductance of transistor 50. The collector current of transistor 32 rises until it equals the base-emitter current times the transistor gain, at which point transistor 32 comes out of saturation. The voltage across winding 34 falls rapidly, reducing the voltage reflected into winding 38 and this, in turn, reduces the base current in transistor 32 to turn off the transistor in a regenerative fashion. Because diode 44 prevents any reversal of current in winding 38, the energy stored in the transformer during the conductive interval of oscillator transistor 32 is reflected into the winding 36. This energy now produces a sharp pulse 48 of current through diode 40 into the output capacitor 42 to charge the capacitor toward the desired output voltage during the flyback interval.

Resistor 54 provides a soft clamp on the voltage at the anode of diode 44 during the flyback interval. Due to the capacitance of diode 44, a relatively high voltage would couple to the collector of transistor 50 when winding 38 changes polarity in the absence of resistor 54.

As described above, winding 38 provides a feedback effect to maintain oscillations. A further feedback effect which positively aids start-up is provided by resistor 56 during the primary charge interval. Resistor 56 acts to increase loop gain just as transistor 32 turns on; i.e., when the current in winding 34 and 38 is still small. Resistor 56 has no function during the flyback interval.

Transistor 58 remains conductive as long as the reference voltage exceeds the feedback voltage applied to the base of transistor 60 by the feedback line 68 from the output circuit 30. The duration of pulses 46 is, therefore, maximized due to the low impedance path for the emitter-base circuit of transistors 32 and 50. This produces maximum energy transfer to the capacitor 42 and consequently rapid charging.

As the output voltage increases towards the desired level, the feedback voltage grows more nearly toward the reference voltage and begins to forward bias transistor 60 and reduce the conductivity of transistor 58. This has the effect of reducing the duration of pulses 46 and increasing the rate at which the pulses occur; i.e., the frequency of the flyback oscillator is increased. As shown in the following formula, this increase in frequency reduces the net power transfer from the primary winding 34 to the secondary winding 36 during the flyback interval. The pertinent relationships are:

(1) Energy $=\frac{1}{2}L_pI_p^2$

Where:

(2)

$L_p$=primary inductance $I_p$=peak primary current (3) $P_t=\frac{1}{2}L_pI_p^2f$ Where:

(4)

$P_t$=power transferred to secondary f=frequency of oscillation (5)

$$I_p = \frac{ET_{on}}{L_p} \tag{5}$$

Where:

(6)

E=input voltage $T_{on}$=primary charge time during which transistor 32 is conducting (7)

$$P_t = \frac{E^2T_{on}\,2_f}{2L_p} \tag{7}$$

Since $T_{on}$ is a very large fraction of the period of oscillation $\tau$, (8)

$$T_{on} \approx \tau = \frac{1}{f} \tag{8}$$

Therefore:

(9)

$$P_t = 1/2\,\frac{E^2}{L_pf} \tag{9}$$

In an actual reduction-to-practice of the circuit of FIG. *2a*, the following component values were found to give satisfactory performance:

| | |
|---|---|
| Winding 34 | 12T, No. 18 |
| Winding 36 | 48T, No. 27 |
| Capacitor 42 | 22 uf |
| Winding 38 | 16T, No. 27 |
| Resistor 52 | 10K |
| Resistor 54 | 470 Ohm |
| Resistor 56 | 20K |
| Resistor 62 | 1K |
| Diode 72 | LM 103 |
| Resistor 70 | 18K |
| Capacitor 74 | 330 uf |
| Transistor 32 | D 45 H 11 |
| Transistor 50 | MPS A 92 |
| Transistors 58, 60 | MPS A 42 |
| Transformer Core | 3019 - 400 - 3B7 |
| Resistor 64 | 390K |
| Resistor 66 | 10K |
| Resistor 78 | 20K |

-continued

| | |
|---|---|
| Diode 80 | 1N914 |

The regulated voltage from converter 14 is applied to oscillator 16 in response to externally generated timing or fuel demand signals. Although the oscillator 16 and injector structure 18 are shown in FIG. 1 as physically separate elements of the system, it will be apparent from the following description that these elements are electrically integrated to the extent that the acoustic injector structure 18 forms part of the oscillator 16 for frequency-determination purposes.

It is further understood that the system of FIG. 1 is representative of both throttle body and multipoint injection systems and of systems having varying numbers of injector structures despite the following description of an illustrative arrangement having a single injector structure.

Figure 2B:
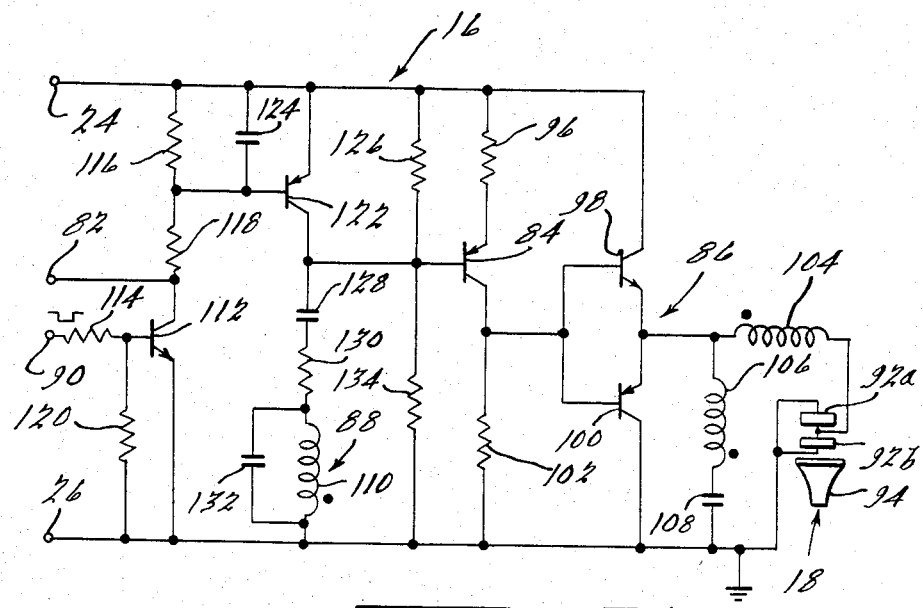

Referring to FIG. 2*b*, the details of a preferred combination of oscillator 16 and injector structure 18 will be described. The oscillator 16 comprises terminals 24 and 26 from converter 14 as previously described, an oscillator transistor 84, a driver stage 86 for applying the alternating current pulses from the oscillator transistor 84 to the acoustic injector structure 18, a tuning circuit generally designated 88, and a gate or trigger signal stage having an input terminal 90 for receiving timing signals from an external source, not shown.

Injector structure 18 is diagrammatically shown in FIG. 2*b* to comprise a pair of matched piezoelectric crystals 92*a*, 92*b*, electrically connected in parallel and mechanically mounted in series to mechanically excite a catenoidal injector horn 94 at a resonant frequency to meter atomized fuel to an engine, not shown. Although illustrated in the environment of a fuel delivery system, it is contemplated that the present invention could be used for the metering and/or injection of various fluids such as liquid fertilizer, paint, and like.

The oscillator transistor 84 has its emitter connected to terminal 24 through a resistor 96 and its collector connected commonly to the base or input electrodes of complementary driver stage transistors 98 and 100 which are alternately rendered conductive as circuit oscillations occur. The collector of transistor 84 is also connected to ground terminal 26 through resistor 102. The emitters of driver transistors 98, 100 are connected through a first transformer winding 104 to the piezoelectric crystals 92*a*, 92*b* of resonant structure 18 to excite the crystals at the frequency of oscillation. This, in turn, excites the horn 94 to meter and atomize fuel in a manner to be described with reference to FIG. 4. In addition, the emitters of driver transistors 98, 100 are connected through a second transformer winding 106 to a capacitor 108 which is selected to substantially match the combined static capacitance of parallel-connected crystals 92*a*, 92*b*, thereby to also excite the capacitor 108 at the frequency of oscillation. The selection of capacitor 108 is made by applying an alternating current signal to crystals 92*a*, 92*b* which is well-removed from the normal frequency of oscillation of circuit 16 and measuring the reaction of crystals 92*a*, 92*b* with a standard capacitance meter.

Both of windings 104 and 106 are magnetically coupled with a secondary winding 110 in the tuning circuit 88 to effectively integrate the resonant structure 18 and the capacitor 108 with the oscillator and, more specifically, to provide two feedback signals to the tuning circuit by transformer action. The feedback signal from winding 104 represents the actual resonant frequency or frequencies of the structure 18 due to both mechanical and electrical properties of the structure 18; i.e., the feedback signal may include a first component determined by the mechanical properties of the entire structure 18 and which is variable with temperature, dirt accumulation and load, and a second component determined by the static capacitance of the crystals 92*a*, 92*b* and which is nonvarying. The feedback signal from winding 106 on the other hand, represents only the response of capacitor 108 to the excitation signal. Windings 110, 104 and 106 are wound on a common core in the senses indicated by the dots in FIG. 2*b* and, therefore, the signal component from winding 106 subtracts from the signal from winding 104 in the secondary winding 110 and results in a feedback signal which is essentially free of the static capacitance component.

Describing the circuit of FIG. 2*b* in greater detail, the control signal or trigger circuit input terminal 90 is connected to the base of an npn transistor 112 through a resistor 114, the collector of which is connected to the power supply terminal 24 through the combination of resistors 116 and 118. The emitter of transistor 112 is connected to ground terminal 26 and the base of transistor 112 is connected to ground through a resistor 120. The junction point between resistors 116 and 118 is connected to the base electrode of a second gate circuit stage comprising pnp transistor 122, the emitter of which is connected to the high side of the supply. A capacitor 124 is connected between the supply and the base electrode of transistor 122. The collector of transistor 122 is connected to the base of oscillator transistor 84 and to one end of a resistor 126 so that as the transistor 122 is turned off and on, the resistor 126 is placed in and out of the base circuit of transistor 84. With resistor 126 in the circuit, transistor 84 is on and with resistor 126 shorted, transistor 84 is off; i.e., cannot oscillate.

The base circuit of transistor 84 further comprises a capacitor 128 and a resistor 130 connected in series with winding 110 and a capacitor 132 connected across winding 110. A resistor 134 is connected between the base of transistor 84 and ground. The emitter of transistor 84 is connected to the high side of the supply through resistor 96 and the collector is connected to ground through resistor 102. Finally, control terminal 82 is connected to the collector of transistor 112.

Before describing the operation of the circuit in detail, reference is taken to FIG. 3 where the equivalent circuit of the structure 18 is shown. This circuit comprises a first leg including the series combination of an inductive component $L_m$, a capacitive component $C_m$ and a resistive component $R_m$ all of which are known to be temperature, load, and contaminant-varying components. The equivalent circuit further comprises a large static capacitance component $C_s$ which is in parallel circuit relationship with the equivalent of the mechanical components and which is not substantially variable. The total current $I_t$ into the equivalent circuit and, hence, the total current into the structure 18 as shown in the circuit of FIG. 2*b*, comprises the sum of the varying current $I_m$ and the nonvarying reactive current $I_c$.

Referring again to FIG. 2*b*, the oscillator circuit is normally off and, hence, no alternating current is transferred through the driver stage 86 to the structure 18 from the DC supply. Specifically, transistors 112, 122 are normally on so as to short-circuit resistor 126 and prevent oscillation of the circuit by biasing transistor 84 off. When the square wave signal is received, transistors 112, 122 turn off. Resistor 126 is no longer short-circuited and therefore biases transistor 84 on. The circuit now has sufficient loop gain and appropriate phase relationship to operate at the mechanically resonant frequency of structure 18 except for $I_c$ which will be canceled out, as later described. The driver stage comprising transistors 98, 100 follows the oscillations of transistor 84 in complementary fashion to provide an alternating current signal to the injector structure 18 via winding 104 and to the compensating capacitor 108 via winding 106.

The feedback signal components of the overall structure 18 are reflected into the base or tuning circuit of transistor 84 via winding 110, but the feedback signal from winding 106 effectively cancels the component due to static capacitance in the crystals 92*a*, 92*b*. Accordingly, the oscillator is inherently resonant at the mechanically resonant frequency of the structure 18 over a wide range of actual operating conditions.

Figure 2A:
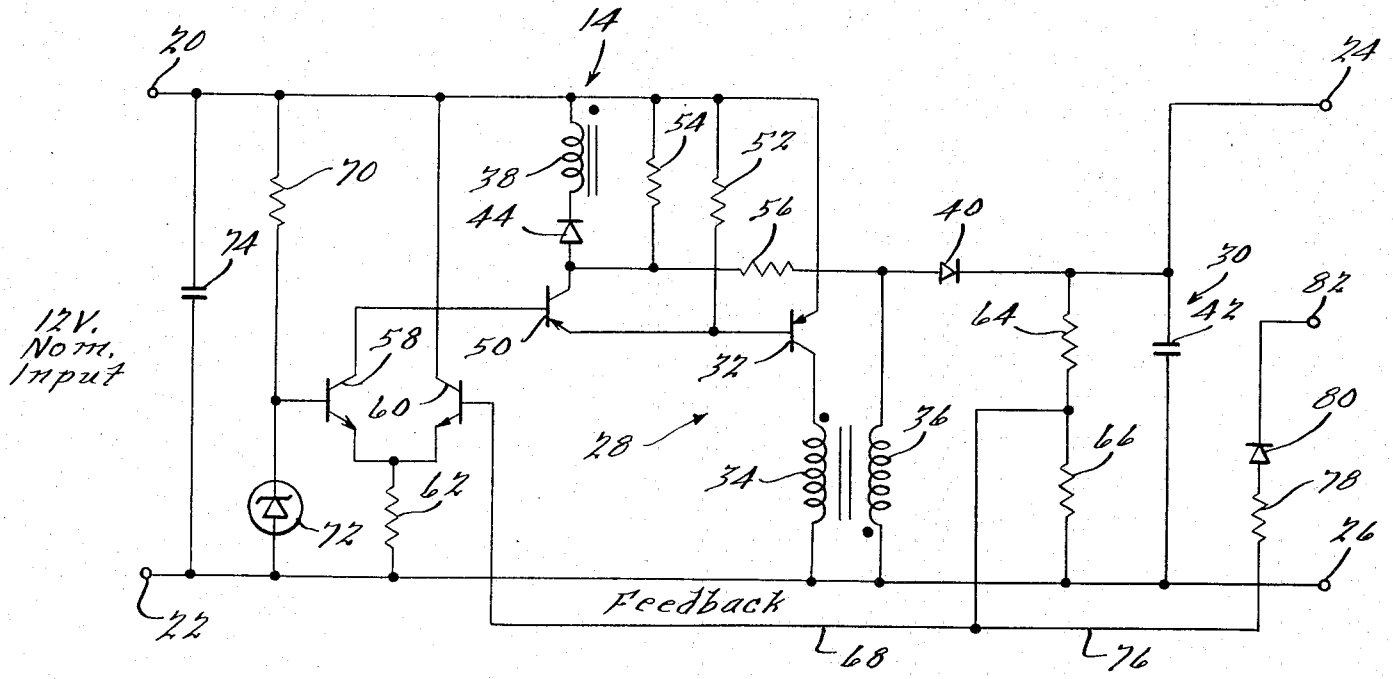

Referring simultaneously to FIGS. 2*a*, 2*b* and 6, operation of the power boost feature of the present invention is as follows. When the modulation input at terminal 90 to oscillator circuit 16 is at a high (5 V) level, as shown in line 1 of FIG. 6, the injector 18 is off and transistor 112 is turned on. In this condition, the diode 80 and resistor 78 conduct current from the power supply feedback signal causing the power supply to regulate at a high voltage level ($V_2$), as illustrated in lines 2 and 3 of FIG. 6, controlled by relative values of the added resistor 78 and the resistor divider network 64 and 66 in converter 14. When the modulation input to the circuit is switched to a low level (OV), the oscillator circuit 16 turns on and transistor 112 is turned off. This reverse biases diode 80. Accordingly, resistor 78 and diode 80 will not conduct current in this state. The output voltage across terminals 24 and 26 of converter 14 will not immediately fall to a lower level ($V_1$) due to energy stored in output capacitor 42. As can be best seen in line 3 of FIG. 6, an exponential decay will take place between $V_2$ and $V_1$ which will be controlled by the value of capacitor 42 and the load; i.e., the power consumed by the circuit itself and the power delivered to injector 18. After the additional stored energy is delivered to the injector 18 through the oscillator 16, the converter 14 then regulates at a lower voltage level ($V_2$) for the duration of the injector-on time. The amount of energy stored resulting in a power boost to the injector is a function of the boost voltage level and the value of output capacitor 42.

In an actual reduction-to-practice, the following circuit values have been found to produce satisfactory results and to achieve the object of the invention as previously stated.

| | |
|---|---|
| Resistor 114 | 1K |
| Resistor 116 | 10K |
| Resistor 118 | 75K |
| Resistor 120 | 10K |
| Capacitor 124 | 470 pf |
| Capacitor 128 | .1 uf |
| Resistor 130 | 220 Ohms |
| Winding 110 | 20T, No. 27 |
| Capacitor 132 | .22 uf |
| Resistor 126 | 5K |
| Resistor 134 | 100K |
| Resistor 96 | 220 Ohms |
| Resistor 102 | 24K |
| Capacitor 108 | 550 pf |
| Winding 104 | 10T, No. 27 |

-continued

| | |
|---|---|
| Winding 106 | 10T, No. 27 |
| Transformer Core | 266 CP 1253B7 Ferroxcube |

Referring now to FIG. 4, the details of a preferred injector structure 18 are shown to comprise a housing 136 carrying a catenoidal horn injector 138 of stainless steel having a throughbore 140. The bore 140 exhibits an area 142 of increased diameter near the injector tip to accommodate and provide seats for a ball 144 which operates as a check valve for fuel flow control purposes. The horn 138 is mechanically grounded in the housing 136 by means of a flange 146. A threaded post 148 extends into a back mass 150 which is loosely pinned into housing 136 as shown. The post 148 is hollow and communicates the bore 140 to a fuel supply through a filter 152.

Crystals 92*a*, 92*b* are sandwiched between the back mass 150 and the flange 150 along with spacer contacts 154 and 156 for electrical connection purposes; i.e., spacer contact 156 is between and abuts one face of each crystal 92*a*, 92*b* but is spaced radially from post 148 to apply the excitation signal to the crystals. Spacer contact 154 provides the ground contact directly to crystal 92*a* and via post 148 and flange 146 to crystal 92*b*. Both spacer-contacts 154 and 156 have center holes and bent-up tabs at the outer radii thereof to center themselves relative to the post 148; this is especially advantageous in the case of contact 156 which must not contact the post 148. A connector 158 brings the lead wires from the external circuit.

It is to be understood that the invention has been described with reference to a specific embodiment which provides the features and advantages previously described, and that such specific embodiment is susceptible of modification as will be apparent to those skilled in the art. For example, the preferred embodiment could be rendered less temperature sensitive by the substitution of two series connected resistors for voltage divider resistor 64 and control line 76 connected to the point of common connection therebetween. This modification would impose a higher voltage level on line 76 which, percentagewise, would be substantially larger than the junction voltage characteristic of the collector emitter junction of transistor 122 and diode 80 to further enhance stability. Accordingly, the foregoing description is not to be construed in a limiting sense.

What is claimed is:

1. An acoustic fuel injector system comprising:

a mechanically resonant injector structure responsive to an alternating current excitation signal to atomize fuel supplied thereto;

oscillator circuit means for producing said alternating current excitation signal in response to a control signal; and a DC-to-DC converter for producing a selectively variable regulated output voltage from an unregulated supply, whereby power applied to said injector structure varies as a function of converter output voltage level.

2. The fuel injector system as set forth in claim 1 wherein said control signal is externally generated.

3. The fuel injector system as set forth in claim 1 wherein said output voltage is characterized as having a relatively high level when said excitation signal is initially applied to said injector structure, and is further characterized as having a relatively low level thereafter.

4. The fuel injector system as set forth in claim 3 wherein said converter comprises energy storage means operative to store energy when said output voltage is at said relatively high level and to discharge said stored energy to said injector structure as said output voltage transitions between said high and low levels.

5. The fuel injector system as set forth in claim 3 wherein said output voltage is nominally at said high level when said injector structure is not receiving said excitation signal.

6. An acoustic injector system comprising:

a mechanically resonant injector structure responsive to an alternating current excitation signal to atomize fluid supplied thereto;

oscillator circuit means for producing said alternating current excitation signal in response to a control signal; and a DC-to-DC converter for producing a selectively variable regulated output voltage from an unregulated supply, whereby power applied to said injector structure varies as a function of converter output voltage level.

7. An acoustic injector system as set forth in claim 6 wherein said output voltage energizes said oscillator circuit as a function of said control signal.

8. The fuel injector system as set forth in claim 1 wherein said output voltage energizes said oscillator circuit as a function of said control signal.

9. An acoustic injector system comprising:

a mechanically resonant injector structure responsive to an alternating current excitation signal to atomize fluid supplied thereto;

oscillator circuit means operative to generate said alternating current excitation signal in response to an externally generated control signal; and a DC-to-DC converter operative to generate a selectively variable regulated output voltage from an unregulated supply, said variable output voltage energizing said oscillator circuit as a function of said control signal, whereby power applied to said injector structure varies as a function of converter output voltage level, said output voltage being characterized as having a relatively high level prior to said injector structure receiving said excitation signal and continuing when said excitation signal is initially applied to said injector structure, and is further characterized as having a relatively low level thereafter, said converter including energy storage means operative to store energy when said output voltage is at said relatively high level and to discharge said stored energy to said injector structure as said output voltage transitions between said high and low levels.

10. An acoustic injector system comprising:

a mechanically resonant injector structure responsive to an alternating current excitation signal to atomize fluid supplied thereto;

oscillator circuit means operative to generate said alternating current excitation signal in response to an externally generated control signal; and a regulated DC-to-DC converter operative to generate a selectively variable output voltage from an unregulated supply, said variable output voltage energizing said oscillator circuit as a function of said control signal, whereby power applied to said injector structure varies as a function of converter output voltage level, said converter including, (i) a flyback oscillator including a transistor connectable to the unregulated supply to periodically conduct current therefrom, (ii) output circuit means coupled to said oscillator for receiving and storing electrical energy therefrom during the interval between said conductivity periods and in amounts which vary with the conductivity period of the oscillator transistor, (iii) variable impedance means connected to the input of the oscillator transistor to vary the conductivity period thereof, (iv) feedback means connected between the output circuit means and the variable impedance means to vary the conductivity period according to the energy stored in the output circuit means and effecting a first regulated DC output voltage level from said converter, and (v) means operable to vary said feedback as a function of said control signal to effect a second regulated DC output voltage level from said converter.

11. The injector system as set forth in claim 10 wherein said oscillator circuit means further comprises a transformer having a primary winding connected in series with the oscillator transistor, and a first secondary winding magnetically coupled to the primary winding, and said output circuit means comprises a capacitor, and rectifier means connecting the secondary winding to the capacitor for transferring energy thereto only during the interval between conductivity periods of the oscillator transistor.

12. The injector system as set forth in claim 11 wherein said feedback means includes a voltage divider connected across the capacitor, said feedback means including means for detecting a portion of the voltage across the divider.

13. The injector system as set forth in claim 12 further including a reference voltage, and differential means for comparing the voltage portion to the reference and controlling the variable impedance means according to such comparison.

14. The injector system as set forth in claim 11 wherein the variable impedance means includes a second transistor having an emitter-base circuit connected in circuit with the emitter-base circuit of the oscillator transistor.

15. The injector system as set forth in claim 11 further including a second secondary winding magnetically coupled to the primary winding and regeneratively connected to the oscillator transistor.

16. The injector system as set forth in claim 15 further including a diode connected in series with the second secondary winding to prevent reverse current flow therethrough as the oscillator transistor switches off.

17. The injector system as set forth in claim 15 further including a feedback resistor connected to the variable impedance means to increase the oscillator loop gain during start-up.

18. The injector system as set forth in claim 10 wherein the flyback oscillator comprises a transformer having primary and secondary windings, and unidirectionally conducting means coupling the secondary winding to the output circuit means.

19. The injector system as set forth in claim 12 wherein said voltage divider comprises at least two impedances having a first fixed ohmic ratio, and said feedback varying means comprises a third impedance selectively coacting with said two impedances to establish a second fixed ohmic ratio.

20. An acoustic injector system comprising:

a mechanically resonant injector structure responsive to an alternating current excitation signal to atomize fluid supplied thereto;

oscillator circuit means operative to generate said alternating circuit excitation signal in response to a control signal; and a regulated DC-to-DC converter operative to generate a selectively variable output voltage from an unregulated supply, whereby power supplied to said injector structure varies as a function of converter output voltage level.

21. The injector system as set forth in claim 20 wherein said mechanically resonant injector structure is operative to both atomize and meter fluid supplied thereto in response to said alternating current excitation signal.

* * * * *